US007004663B1

(12) United States Patent
Cupidon-Ebanks

(10) Patent No.: US 7,004,663 B1
(45) Date of Patent: Feb. 28, 2006

(54) BATHROOM CLEANING DEVICE

(76) Inventor: Carolyn Cupidon-Ebanks, 1720 Harrison St., #10-A, Hollywood, FL (US) 33020

( * ) Notice: Subject to any disclaimer, the term of this patent is extended or adjusted under 35 U.S.C. 154(b) by 0 days.

(21) Appl. No.: 11/135,867

(22) Filed: May 24, 2005

(51) Int. Cl.
*A46B 11/04* (2006.01)
*A46B 11/00* (2006.01)

(52) U.S. Cl. ..... 401/279; 401/44; 401/45; 401/140; 401/278

(58) Field of Classification Search ..... 401/44–47, 401/140, 205–207, 270, 278, 279, 280
See application file for complete search history.

(56) References Cited

U.S. PATENT DOCUMENTS 2,521,929 A * 9/1950 McNeill, Jr. ..... 401/46
2,955,311 A 10/1960 Jurkanis
3,960,454 A * 6/1976 Schroeder ..... 401/140
4,027,984 A * 6/1977 Underwood ..... 401/28
4,225,254 A 9/1980 Holberg et al.
4,826,340 A 5/1989 Rothweiler et al.
5,186,559 A * 2/1993 Fu ..... 401/44
5,445,596 A * 8/1995 Grace ..... 601/154
5,454,659 A 10/1995 Vosbikian et al.
D384,436 S 9/1997 Kelley
5,695,293 A * 12/1997 Chase ..... 401/44
D434,911 S 12/2000 Lynch et al.
D447,635 S 9/2001 Smith
6,491,463 B1 12/2002 Richard

* cited by examiner

*Primary Examiner*—David J. Walczak
(74) *Attorney, Agent, or Firm*—Lawrence J. Gibney, Jr.

(57) ABSTRACT

A cleaning device, which has a swivel mounted removable sponge, a rigid arm, a pair of hollow tubes, and a hollow handle capable of containing cleaning fluid. Buttons located on the handle allow the user to release the cleaning fluid into the tubes and down into the sponge during use.

6 Claims, 4 Drawing Sheets

BATHROOM CLEANING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Currently, when one desires to clean a bathroom, it is necessary to have multiple tools to reach the various regions of the room. In addition, when mopping the floor or cleaning the walls, the user often is required to use a separate sponge and bucket. When one wishes to clean the bathtub, one must operate on his knees with his back bent over. In all, cleaning a room, especially a bathroom, is not a comfortable or practical endeavor but very necessary.

A. Field of the Invention

The present invention relates to a device for cleaning. It further relates to a device for cleaning multiple regions of a room.

B. Prior Art

Prior art exists which aids in the act of cleaning regions of a room. An example of such prior art is Jurkanis U.S. Pat. No. 2,955,311. However, this prior art patent fails to perform the same function as the present invention. This prior art patent also does not have the same structure as the present invention.

Prior art also exists which relates to the simple cleaning of objects. Examples of such prior art are Vosbikian U.S. Pat. No. 5,454,659, Rothweiler U.S. Pat. No. 4,826,340, Richard U.S. Pat. No. 6,491,463, Smith U.S. Pat. No. D447,635, Kelly U.S. Pat. No. D384,436, Holberg U.S. Pat. No. 4,225,254, and Lynch U.S. Pat. No. D434,911. However, these prior art patents are dissimilar in structure in that they are generally smaller and handheld objects of a fixed design. The present invention rests on a fixed surface, such as a floor, and has swivel capabilities. In addition, the present invention utilizes separate tubes to transfer cleaning fluids from the handle to the cleaning device. The prior art patents do not have such a feature.

BRIEF SUMMARY OF THE INVENTION

The present invention is a cleaning tool that would be used to clean the bathtub, shower, walls, and surrounding area. It consists of a handle with several buttons which lead to a series of internal, refillable tubes to be filled with cleaning fluids. At the other end of the device is an interchangeable and detachable swivel sponge head. The sponge head receives the cleaning fluids through connection tubes. The fluid is released by the user pressing one of the buttons on the handle. This device will be large enough so that the user may stand in an erect position and clean the floor, similar to the method for using a mop. In addition, the device will be light enough to use when cleaning a wall. The sponge head will also swivel so as to allow the user to clean the interior of a bathtub.

It is an object of this device to create one tool to clean multiple areas of a room. It is a further object of this device to store and dispense cleaning fluids for the purpose of cleaning, if that is desired or necessary.

DETAILED DESCRIPTION OF THE EMBODIMENTS

DRAWING REFERENCE NUMERALS

Figure 1:
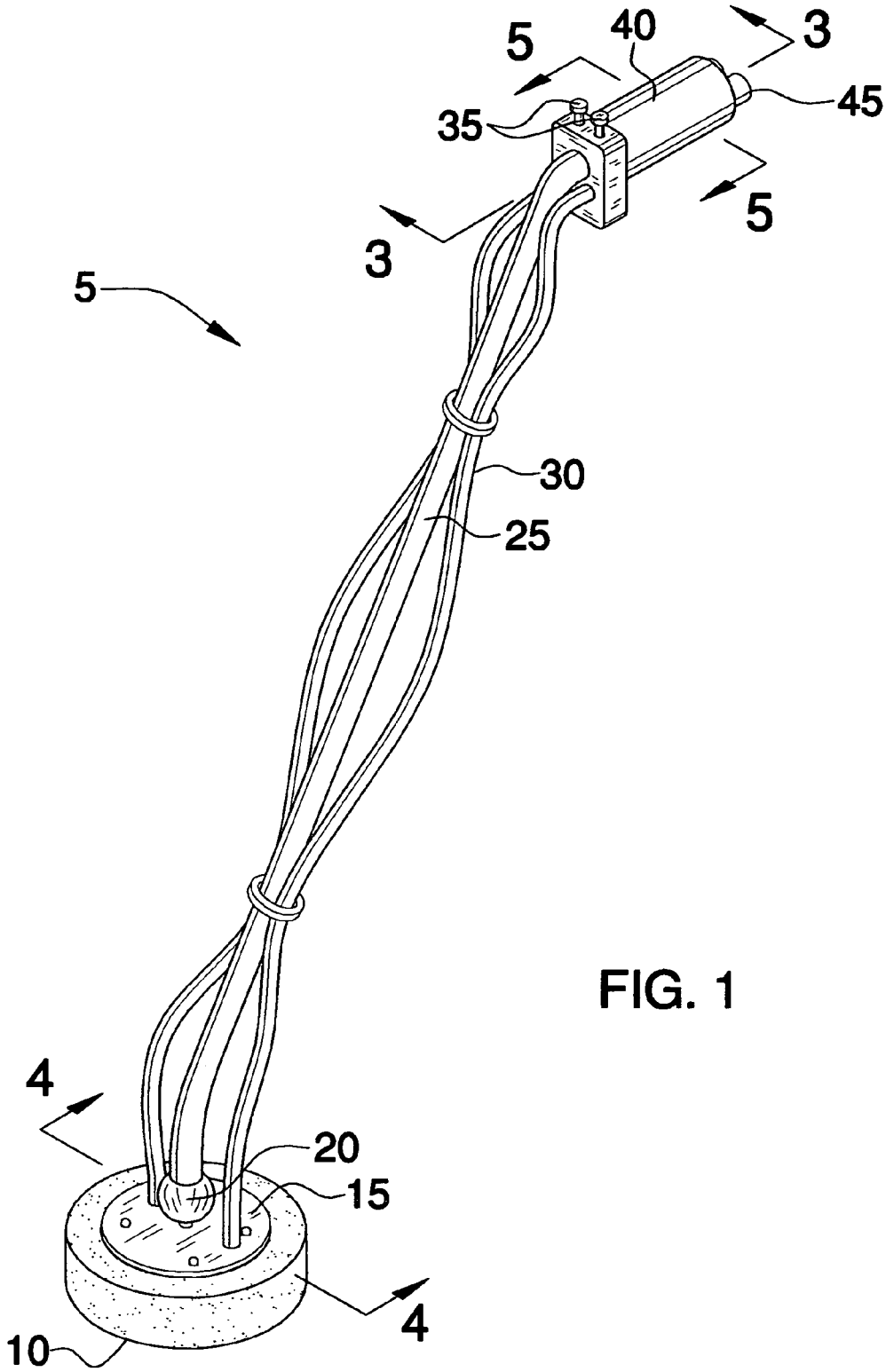
FIG. 1 is a perspective view of the device as it would look in use.
Figure 2:
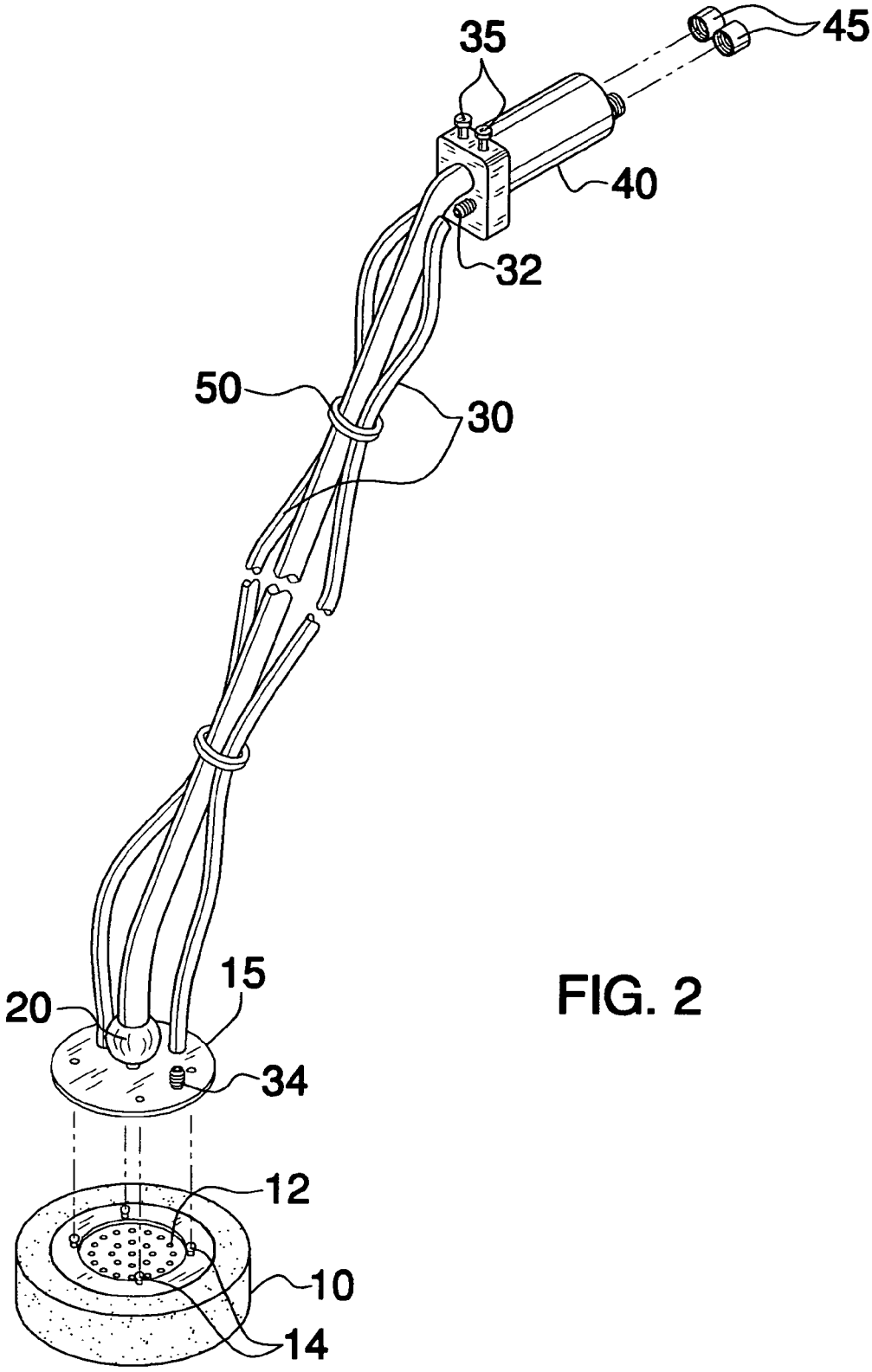
FIG. 2 is an isometric exploded view of the device.

5 Device
10 Sponge
12 Holes
14 Clasping Balls
15 Plate
20 Swivel Point
25 Arm
30 Hose
31 Opening to Tubes
32 Second Hose Barb
34 First Hose Barb
35 Activation buttons
36 Spring
37 Piston
40 Handle/Canister
41 Cleaning solution
42 Liquid cleaning fluid/cleaning canister
43 Cleaning solution
45 Cap
50 Tie The present invention is a device 5 to be used as a replacement for a mop when cleaning a room, specifically a bathroom. At the bottom end of the device 5 will be a sponge 10. FIG. 1 The sponge 10 will be removable and interchangeable. The sponge 10 will contain a central plate or piece with holes 12 and several clasping mechanism or clasping balls 14. The sponge 10 will be attached to a solid and flat plate 15. FIG. 2 The plate 15 will have several holes around its periphery and the clasping balls 14 will be securely inserted through these holes to lock the sponge in place. A swivel 20 will be attached to the center of the plate 15 on the side opposite the sponge 10 and allow the direction of the sponge to conform to the shape or contour of the surface to be cleaned. FIG. 1

Figure 4:
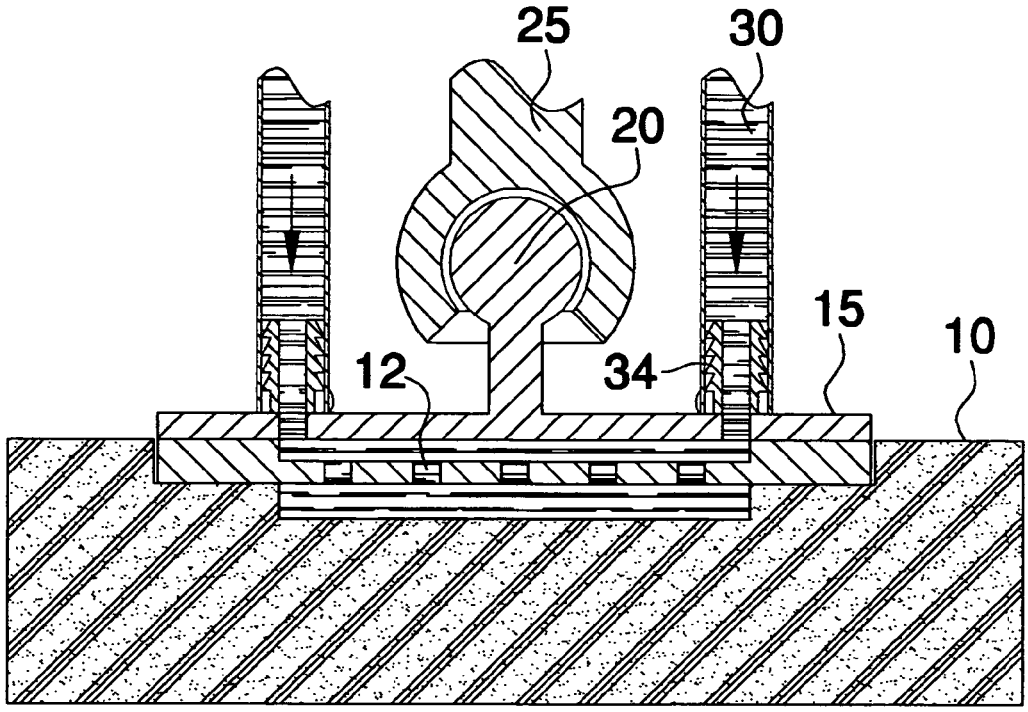
FIG. 4 is a view of the cleaning head taken along line 4—4 on FIG. 1.

Secured to and extending upwardly from the swivel 20 is an elongated arm 25. This arm 25 will be rigid and provide support and shape to the device 5. A pair of hoses 30 will extend alongside the arm 25 from the plate 15. The hoses 30 will connect to the plate 15 on a first pair of hose barbs 34. FIGS. 2, 4 The hose barbs 34 are hollow and extend from one side of the plate 15 to the other. The hoses 30 will be secured to the arm 25 through the use of ties 50. At the end of the arm 25 and hoses 30 on the opposite end of the device 5 will be a handle/cleaning canister 40. The arm 25 will be securely attached to the front side of the handle/canister 40. The handle/canister 40 will be hollow and will allow a cleaning fluid within the canister 40 and also act as a handle for the device. FIGS. 1, 2

A second pair of hose barbs 32 will be stationed at and extend from the external side of the front of the handle/canister 40 to the interior side. The pair of hoses 30 will attach to the second pair of hose barbs 32 on the external side. On the top of the handle/canister 40 are a pair of activation buttons 35. On the rear surface of the handle/canister 40 is one or more caps 45. FIG. 2

Figure 3A:
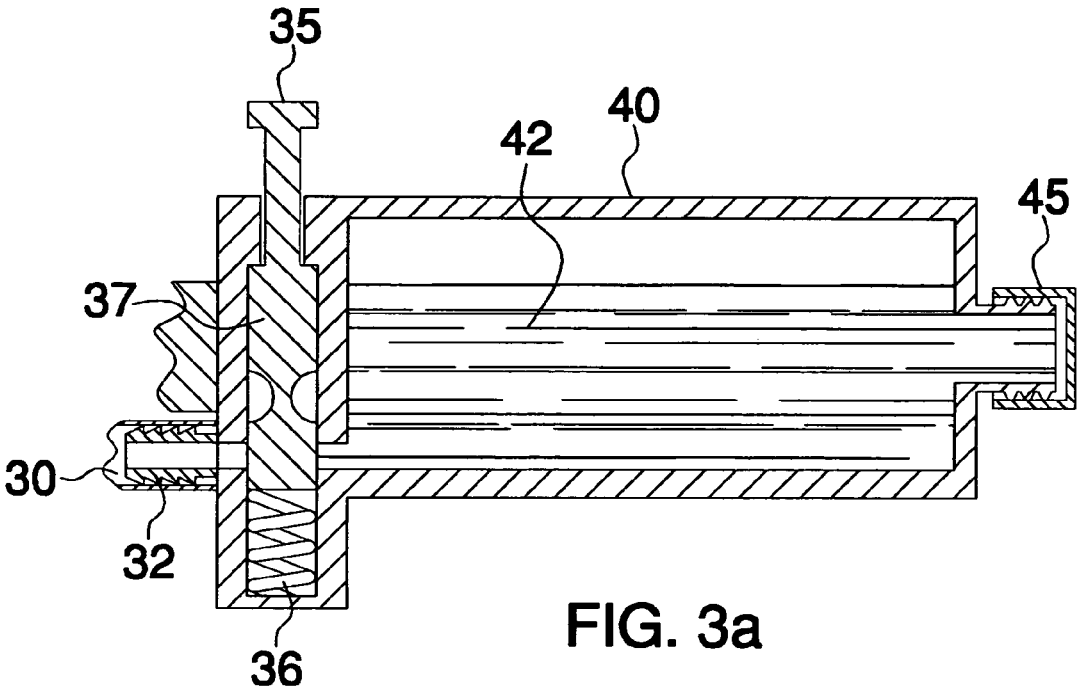
FIG. 3*a* is a view of the handle taken along line 3—3 on FIG. 1 showing the button on the handle not depressed.
Figure 3B:
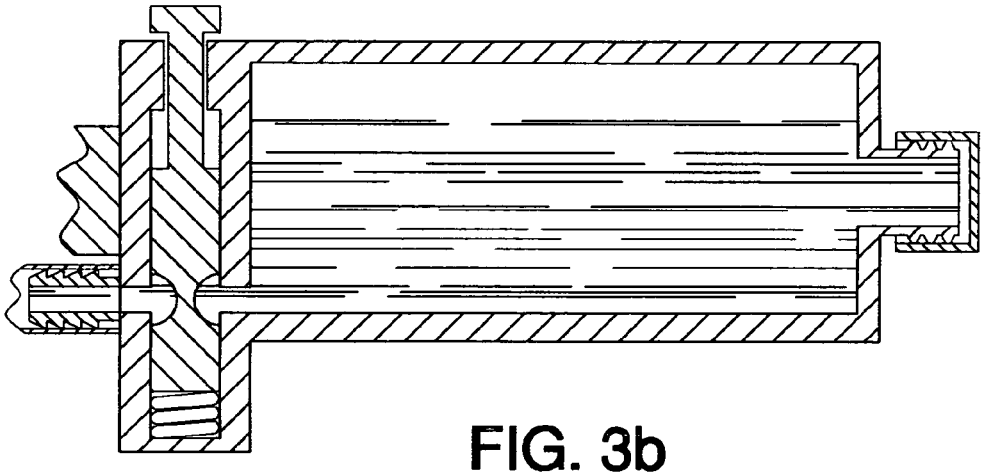
FIG. 3*b* is a view of the handle taken along line 3—3 on FIG. 1 showing the button on the handle depressed.
Figure 5:
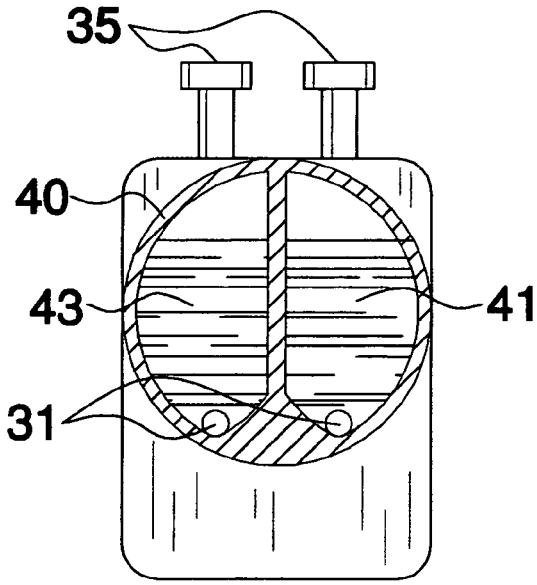
FIG. 5 is a view of the cleaning canister according to line 5—5 on FIG. 1.

Within the interior of the handle/canister 40 is the liquid cleaning fluid 42. FIGS. 3*a*, 3*b*, 5 The pair of activation buttons 35 are connected to a piston 37 which sits on a spring 36. FIGS. 3*a*, 3*b* An opening is provided in the piston 37 to allow cleaning fluid 42 to travel from the interior of the canister 40 to the second hose barb 34 through the opening 31 in the canister. FIG. 5 When one of the buttons 35 is depressed, the piston 37 pushes the spring 36 down and exposes the second hose barbs 32 to the cleaning fluid 42 such as depicted in FIG. 3*b*. When the button 35 is released, the spring 36 pushes the piston 37 upward and closes the opening of the second hose barbs 32 thus preventing the flow of liquid cleaning fluid 42 into the hoses 30 such as depicted in FIG. 3*a*. It is anticipated that the cleaning canister 40 will have two separate compartments in which to store two different cleaning solutions 41, 43 if desired. FIG. 5 There are two separate canisters which are operated by two separate piston and spring arrangements. This will enable the user to put different kinds of cleaning solutions in the respective canister if so desired.

The cleaning fluid 42 is placed in the handle/canister 40 by removing the caps 45. Once the handle/canister 40 is full, the cap 45 is replaced. The device 5 should be made of durable and lightweight material, such as plastic. The approximate size of the device 5 is a length of between three and four feet long.

What is claimed is:

1. A device for cleaning comprising:

a. a removable sponge;

wherein the sponge is inserted over a central plate;

wherein the central plate has a plurality of holes;

wherein the central plate has a plurality of clasping mechanisms;

b. a plate;

wherein the plate has a top surface and a bottom surface;

wherein the plate has a plurality of holes to secure the plate to the central plate;

wherein the plate has a plurality of hose barbs on the top surface;

c. a swivel mechanism;

wherein the swivel mechanism is securely connected to the plate;

d. a substantially elongated arm structure;

wherein the arm structure has a first end and a second end;

wherein the arm structure is of a substantially rigid shape;

wherein the first end of the arm structure is fixedly attached to the swivel mechanism;

e. a substantially hollow handle;

wherein the handle has a front and a back side;

wherein the front side of the handle is fixedly attached to the second end of the arm structure;

wherein the front side of the handle has a plurality of hose barbs;

wherein the back side has a plurality of openings covered by removable caps;

wherein there are a plurality of individual hollow interior containers;

said containers have a first and second opening;

said first opening is fixedly attached to a hose barb on the interior of the front side of the handle;

said second opening is fixedly attached to the interior of the back side of the handle and is aligned with the openings on the back side of the handle;

wherein the handle has a plurality of depressible buttons;

wherein the buttons operate a respective piston and spring;

f. a plurality of substantially elongated hollow tubes;

wherein the tubes have a first and second end;

wherein the first ends are fixedly attached to the hose barbs on the plate;

wherein the second ends are fixedly attached to the hose barbs on the front end of the hollow handle;

g. a piston;

wherein an opening is provided on the piston wherein the operation of the piston allows cleaning fluid to travel from the canister into the hollow tube;

h. container;

wherein a plurality of containers is provided;

wherein a cap is provided for each container;

wherein a predetermined amount of cleaning fluid is contained in each container.

2. The device described in claim 1 wherein there are two hollow tubes, two hose barbs in the plate device, hose barbs in the handle, two buttons, two piston and spring mechanisms, two interior containers, and two caps.

3. The device as described in claim 1, having two distinct states:

when the buttons are depressed, the piston and spring mechanisms open the connection between the hollow tubes and the interior containers;

and when the buttons are not depressed, the piston and spring mechanisms close the connection between the hollow tubes and the interior containers.

4. The device as described in claim 1 wherein the clasping mechanisms define clasping balls that are inserted through the plurality of holes in the plate.

5. The device as described in claim 1 wherein a desired type of cleaning fluid is inserted into the interior containers through the openings in the back side of the handle.

6. A method for using the device as described in claim 1 comprising the following steps:

a. removing the caps from the back side of the container;

b. inserting cleaning fluid through the openings in the back side of the containers and into the interior containers;

c. replacing the caps onto the back side of the handle;

d. depressing the buttons on the handle;

e. allowing the cleaning fluid to flow from the handle, through the hollow tubes, and down to the sponge; and f. releasing the buttons on the handle to cease the flow of cleaning fluid.

* * * * *